United States Patent [19]

Dallaire et al.

[11] Patent Number: 4,901,921

[45] Date of Patent: Feb. 20, 1990

[54] PARTICLE INJECTION DEVICE FOR THERMAL SPRAYING

[75] Inventors: Serge Dallaire, Longueuil; Denis Spino; Blaise Champagne, both of Boucherville, all of Canada

[73] Assignee: Canadian Patents and Development Limited, Ottawa, Canada

[21] Appl. No.: 314,231

[22] Filed: Feb. 21, 1989

Related U.S. Application Data

[63] Continuation of Ser. No. 41,448, Apr. 23, 1987, abandoned.

[30] Foreign Application Priority Data

Apr. 25, 1986 [CA] Canada ..... 507649

[51] Int. Cl.[4] ..... B05B 1/24

[52] U.S. Cl. ..... 239/11; 239/85; 219/76.16; 219/121.47

[58] Field of Search ..... 234/79, 81, 85, 11; 406/168, 173; 219/121 PL, 76.16; 209/144

[56] References Cited

U.S. PATENT DOCUMENTS

| | | | |
|---|---|---|---|
| 3,151,913 | 10/1964 | Forsyth | 406/168 |
| 3,573,090 | 3/1971 | Peterson | 239/81 |
| 4,199,104 | 4/1980 | Houben | 239/81 |

FOREIGN PATENT DOCUMENTS 46-37081 11/1971 Japan .

*Primary Examiner*—Andres Kashnikow
*Assistant Examiner*—Karen B. Merritt
*Attorney, Agent, or Firm*—Fleit, Jacobson, Cohn, Price, Holman & Stern

[57] ABSTRACT

There is described a method and an apparatus wherein particles and a carrier gas are injected under pressure into a plasma flame. The particles are completely melted and are theraefter propelled onto a substrate to produce a coating thereon. According to the invention, the speed of the particles is slowed down and the flow of the gas carrier is adjusted, such as by disposing a cyclone ahead of the plasma flame, so as to provide an efficient injection of the particles in the center of the plasma flame.

5 Claims, 3 Drawing Sheets

PARTICLE INJECTION DEVICE FOR THERMAL SPRAYING

This is a continuation of Ser. No. 041,448, filed 4/23/87, now abandoned.

BACKGROUND OF THE INVENTION (a) Field of the Invention

This invention relates to a method and a device for the injection of particles for thermal spraying. More particularly, the present invention relates to a method which enables to inject particles into the plasma flame so as to ensure that substantially all the particles are completely melted and adequately propelled onto a surface intended to be coated. The invention also relates to a device which permits to slow down the speed of the particles and at the same time adjust the flow of carrier gas so as to provide an efficient injection of the particles into the center of the flame.

(b) Description of Prior Art

The plasma spraying process is a process in which materials to be deposited (generally powders) are introduced into a hot gas stream and are thereafter propelled onto the surface of a substrate. The powders consisting of materials to be deposited are heated when they enter the plasma. The heated particles must be molten or in a plastic state when they leave the hot gas effluent. The impacting particles flatten, interlock and overlap one another, securely bonding together and forming a coherent layer of material onto the substrate. When the substrate is properly prepared, it forms an adherent bond with the coating layer.

The material to be sprayed, such as powders, is pneumatically carried from the powder feeder to the plasma gun by means of a gas, generally an inert gas such as argon. This carrier gas serves to convey particles of the material to be sprayed to the plasma gun and also impart kinetic energy to the particles which must be injected as close as possible to the middle of the plasma flame.

One major problem faced by the common practice of plasma spraying is the following. The particles must be injected into the plasma as close as possible to the middle of the flame in order to be completely melted and be adequately propelled onto the substrate. In addition, the flow rate and pressure of the carrier gas must be sufficiently high to carry the powders to the gun but the same should be low enough in order that the particles do not travel transversally through the plasma flame.

Generally, the user of a plasma torch selects flow rate and pressure valves for the carrier gas by a traial-and-error procedure, and experience has shown that most of the time, the particles are not properly injected into the flame. If the gas flow rate and the pressure are too low, either the powders are not carried to the plasma gun or they are deflected by the plasma flame. On the other hand, if the gas flow rate and the pressure are too high, a portion of the particles travel transversely through the plasma flame and are not properly melted and accelerated onto the substrate.

For these reasons, the quality of the coatings produced by plasma spraying as well as the efficiency of the process suffer form the fact that the particles are not properly injected into the plasma flame.

U.S. Pat. No. 4,199,104 issued Apr. 22, 1980 to Johan M. Houben and Japanese 7137081 issued to Kobe Steel Works Ltd. both relate to the release of the carrier prior to injecting the powder into the plasma stream. The Japanese Patent uses a device which consists of a movable sleeve provided with an orifice. U.S. Pat. No. 4,199,104 discloses a perforated or porous wall and a sliding shutter which is impermeable to the gas. Obviously, although these references recognize the problem of properly injecting the particles into the plasma stream, neither of them provide an adequate means for the correct injection of particles into the plasma stream. Even though the momentum of the particles is modified, it is not adequately controlled and the process is not reproducible from one experiment to the other. Furthermore, the use of the devices of both patents is time consuming, a substantial amount of powder would be lost through the orifice or orifices and the porous impermeable membrane can become clogged up or obstructed by the powder.

It is an object of the present invention to provide a method for suitably and correctly injecting the particles into the plasma flame.

It is another object of the present invention to provide a device which permits to slow down the speed of the particles and at the same time adjusts the flow rate of the carrier gas so as to efficiently inject the particles into the center of the flame.

It is another object of the present invention to provide an apparatus which acts to remove a portion of the carrier gas immediately before the latter enters the plasma gun.

It is another object of the present invention to provide for a partial separation of the particles in order to eliminate fine dust and carrier gas fed to the plasma flame and supplied from a powder hopper.

It is another object of the present invention to produce a narrow spray pattern of completely melted particles which results in coatings of better quality and less material waste.

SUMMARY OF THE INVENTION

These and other objects of the present invention may be achieved in a method wherein particles and a carrier gas are injected under pressure into a plasma flame, the particles being substantially completely melted and thereafter propelled onto a substrate to produce a coating thereon. According to the invention, the speed of the particles is slowed down while at the same time the flow of carrier gas is adjusted so as to provide an efficient injection of the particles in the center of the plasma flame.

According to a preferred embodiment of the invention, this is achieved by extracting a sufficient portion of the particles and carrier gas.

According to another preferred embodiment of the invention, the particles and the carrier gas under pressure are circulated through a cyclone to slow down the speed of the particles and to separate part of the carrier gas.

According to another preferred embodiment of the invention, fine particles present in the carrier gas are filtered away.

Another object according to the invention resides in a plasma torch wherein a plasma flame is produced between two electrodes and particles and a carrier gas therefore are injected under pressure in the plasma flame from a powder hopper, said plasma torch being improved by having means therein for simultaneously slowing down the speed of the particles and adjusting the flow of the carrier gas so as to provide an efficient injection of the particles at the center of the plasma flame.

According to a preferred embodiment of the invention, the plasma torch comprises means for extracting a sufficient portion of the particles and carrier gas to achieve an efficient injection.

According to another preferred embodiment of the invention, the torch comprises a cyclone disposed between the powder hopper and the plasma flame.

According to another preferred embodiment of the invention, there is provided an outlet duct on the cyclone through which the gas carrier is removed. A filter may be mounted along the duct to remove the fine particles present in the removed portion of carrier gas.

BRIEF DESCRIPTION OF DRAWINGS

The invention will now be illustrated by means of the following drawings but is not limited thereby. In the drawings.

DESCRIPTION OF PREFERRED EMBODIMENTS

Figure 1:
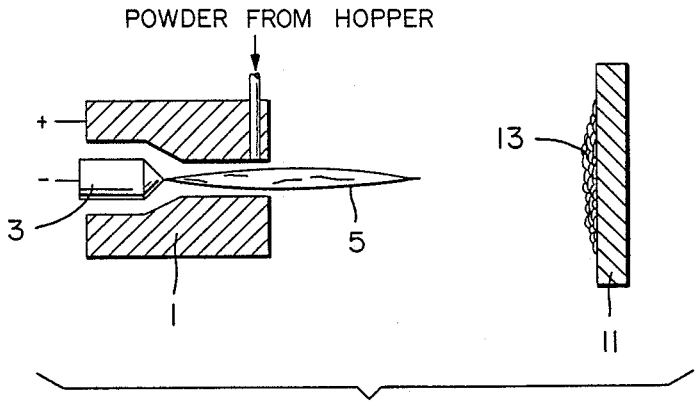
FIG. 1 is a schematic representation of a plasma spraying apparatus of the prior art.

Referring to the drawings, it will be seen that a plasma spraying apparatus of the prior art comprises a positive electrode 1 and a negative electrode 3. The apparatus is fed with a gas not shown which produces a plasma flame 5. For coating purposes, a mixture of powder and carrier gas under pressure is fed from powder hopper 7 through a suitable duct 9 until it hits the plasma flame 5. Theoretically, the particles are completely melted and are thereafter propelled onto substrate 11 to produce a coating 13.

Now it has been realized that to provide a near 100 percent yield, which is obtained when substantially all the particles are melted and propelled against the substrate, is nearly impossible. As pointed out above, some particles are deflected by the plasma flame and others travel transversely therethrough.

Figure 2:
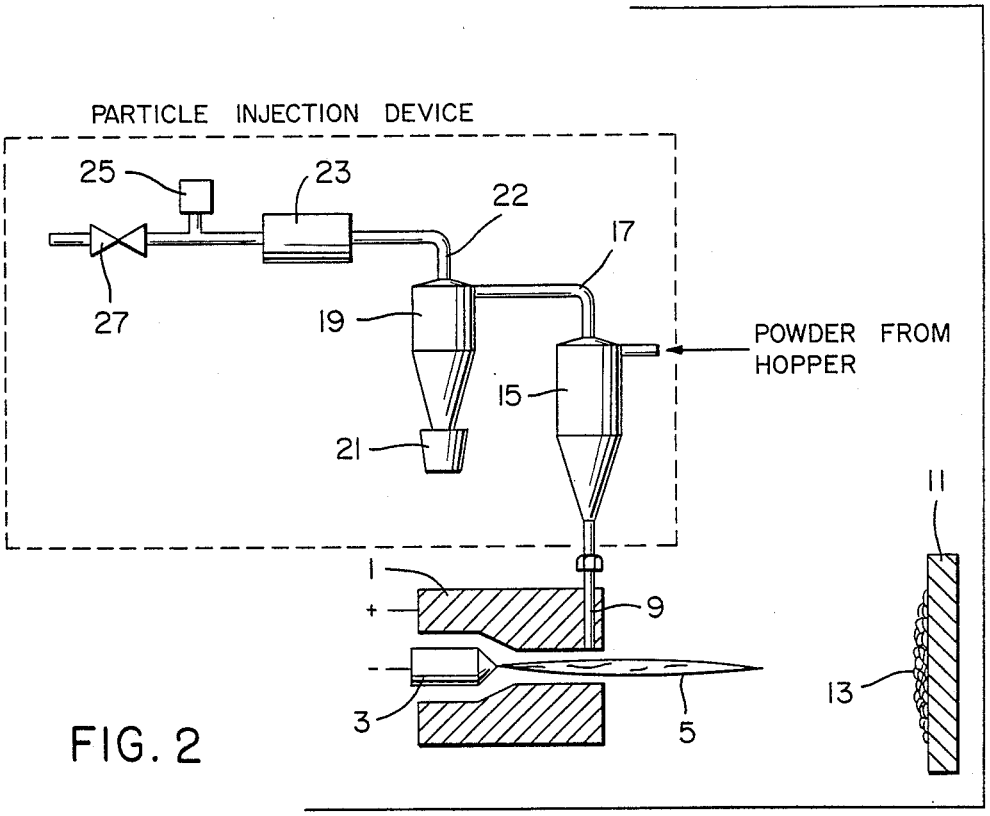
FIG. 2 is a schematic representation of a plasma spraying apparatus according to the invention.

Referring to FIG. 2 which illustrates a preferred embodiment of the invention, it will be seen that a cyclone 15 has been mounted between the plasma flame 5, duct 9 and the powder hopper 7. It was realized that the introduction of cyclone 15 between the powder hopper 7 and the plasma flame 5 contributes to substantially reduce the speed of the mixture of particles and carrier gas which is fed by the powder hopper. In other words, under normal conditions, the pressurized mixture which is fed by the powder hopper is under a pressure which is too high to concentrate substantially all the particles at the heart of the plasma flame 5, with the result that some of the particles travel travsversely through the plasma flame 5. If the presence is reduced, a substantial quantity of particles are deflected. By providing cyclone 15 under a suitable pressure, as will be discussed later, substantially all the particles are propelled at the heart of the plasma flame 5.

To do this, the cyclone 15 is provided with an outlet duct 17 and is kept under a predetermined pressure by means of the control valve 27. The exact pressure is measured on the pressure gauge 25. In this manner, since the pressure which is required to propel substantially all the particles at the heart of the plasma flame 5 is less than the pressure under which the particles and carrier gas are fed by the powder hopper 7, a portion of the carrier gas will be separated in the cyclone and will exit through outlet duct 17. The separated gas which may contain some fine particles will travel through a secondary cyclone 19 which will enable to recover some of the fine entrained particles deposited in the container 21. Some gas will also escape at 22 to be sent through a filter 23 where all the remaining fine particles will be stopped. The reason for the presence of the filter 23 and cyclone 19 is to secure the pressure transducer 25 and the control valve 27 from fine particle.

It will therefore be seen that, in operation, the powder hopper will feed a supply of particles and carrier gas under a pressure which exceeds that which is required to be propelled at the heart of plasma flame 5. This is essential since, otherwise, the particles will not be capable of travelling to the plasma flame 5. Now, in order to reduce or slow down the speed of the particles and to adjust the flow of carrier gas so as to provide an efficient injection of the particles at the center of the plasma flame 5, it is necessary to extract a portion of the carrier gas which contain some small particles. The way to achieve it is to send the mixture of particles and carrier gas through cyclone 15 which is kept under a predetermined pressure by means of control valve 27, which pressure is lower than that under which the powder hopper feeds the mixture of carrier gas and particles. In this manner, it has been found that substantially all the particles will be propelled at the center of the plasma flame 5. So if one wishes to produce a coating with a high yield, with substantially less particles loss, the insertion of a cyclone between the powder hopper 7 and the plasma flame, is a great help.

The advantages of the invention will be understood by means of the following examples:

EXAMPLE 1

A PZT powder having the following characteristics:

| | |
|---|---|
| Particle Size: | −125 + 75 μm |
| Apparent density (per ASTM B212-82) | 2.63 g/cm$^3$ |

is fed into the plasma torch with the following parameters:

| | |
|---|---|
| Working gas | Argon/32 vol. % He |
| Gas flow rate (l/s) | 1.23 |
| Arc Current (A) | 700 |
| Arc Voltage (V) | 37 |
| Powder Feed | |
| Spray rate (g/s) | 0.23 |
| Carrier gas | Argon |
| Gas flow rate (l/s) | 0.11 |

Figure 3A:
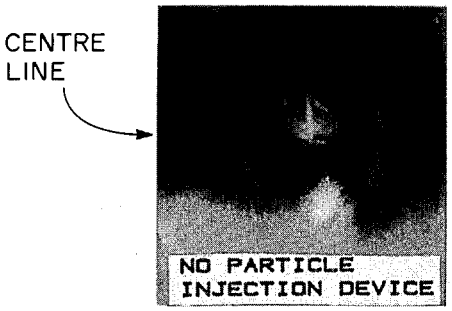
FIGS. 3*a* and 3*b* represent the typical aspects of PZT deposits without and with particle injection device.
Figure 3B:
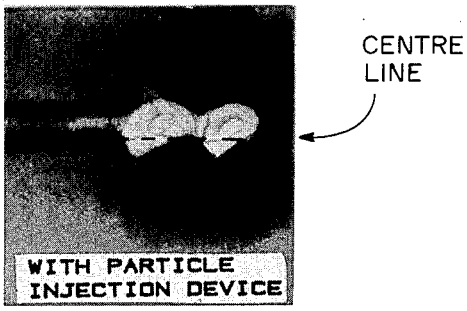

Without the use of the particle injection device, it was not possible to correctly deposit a coating. The coating efficiency, i.e. the amount of powder deposit onto the substrate as compared to the amount of powder fed into the plasma gun, was only 8%. When the particle injection device is used, the deposition efficiency was increased up to 55%, FIG. 3 depicts the typical aspect of the deposit. Narrow spot very well centered with the flame was obtained with the particle injection device as compared to a diffuse deposit when the particle injection device was not used.

EXAMPLE 2

An Al-Fe composite powder having the following characteristics:

Particle Size: $-106+32$ μm

Apparent density (per ASTM B212-82): 0.15 g/cm$^3$ was plasma sprayed with the following characteristics:

| | |
|---|---|
| Working gas | Argon |
| Gas flow rate (l/s) | 0.96 |
| Arc Current (A) | 500 |
| Arc Voltage (V) | 32 |
| Powder Feed | |
| Spray rate | 0.25 g/s |
| Carrier gas | Argon |
| Gas flow rate | 0.09 |

Figure 4A:
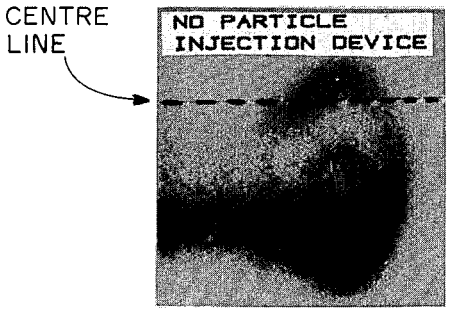
FIGS. 4*a* and 4*b* represent the typical aspects of Al-Fe deposits without and with particle injection device.
Figure 4B:
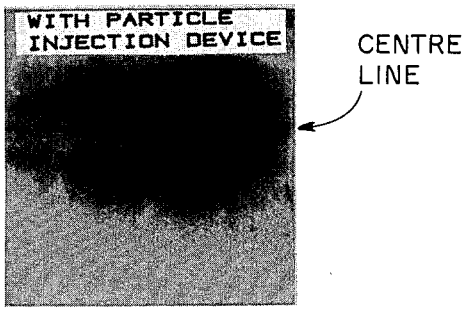

FIG. 4 shows the typical appearance of deposits made with these parameters. It is seen that the use of the particle injection device leads to the formation of a narrow deposit well centered with the plasma flame whereas the deposit is large and not centered with the plasma flame when the injection particle device is not used.

EXAMPLE 3

A TiC powder having the following characteristics:

| | |
|---|---|
| Particle Size: | $-44+10$ μm |
| Apparent density (per ASTM B212-82) | nonfree-flowing |

was plasma sprayed with the following parameters:

| | |
|---|---|
| Working gas | Argon/10 vol. % $H_2$ |
| Gas flow rate (l/s) | 0.83 |
| Arc Current (A) | 500 |
| Arc Voltage (V) | 52 |
| Powder Feed | |
| Spray rate (g/s) | 0.08 |
| Carrier gas | Argon |
| Gas flow rate (l/s) | 0.08 |

Figure 5A:
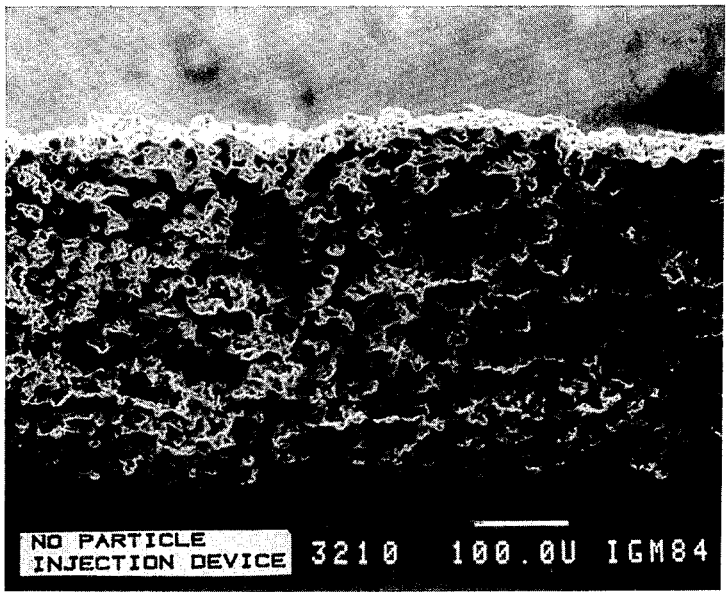
FIGS. 5*a* and 5*b* represent the typical microstructures of TiC coatings without and with particle injection device.
Figure 5B:
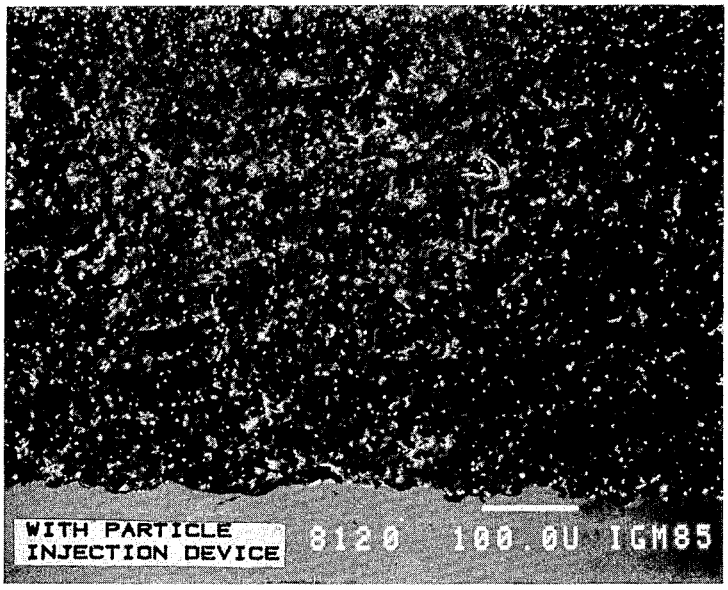

FIG. 5 illustrates the microstructure of coatings obtained with and without the use of the injection particle device. Coatings with higher density are produced when the injection particle device is used.

We claim:

1. In a method wherein particles and a carrier gas are injected under pressure into a plasma flame, said particles being substantially completely melted and are thereafter propelled onto a substrate to produce a coating thereon, the improvement which comprises circulating said particles including associated fine dust and carrier gas through a cyclone and adjusting gas pressure therein so as to slow down the speed of said particles as they penetrate into said flame, substantially homogenize momentum of each particle as the particles meet the plasma flame, substantially separate said fine dust from said particles and introduce said particles into said plasma flame along a path induced by said cyclone at an outlet thereof, thereby achieving substantial interaction essentially between said particles, in the center of the plasma flame, without substantial deflection of said particles on the one hand, and with the substrate on the other hand.

2. A method according to claim 1, which further comprises the step of removing a portion of said carrier gas from said cyclone containing said fine dust which has been separated in said cyclone.

3. In a plasma torch wherein a plasma flame is produced between two electrodes and particles and a carrier gas thereof are injected under pressure in said plasma flame from a powder hopper, the improvement which comprises a cyclone disposed between said hopper and said plasma flame and gas pressure adjusting means associated with said cyclone effective to slow down the speed of said particles as they penetrate into said plasma flame, substantially homogenize momentum of each particle as the particles meet the plasma flame, substantially separate fine dust associated with said particles, and introduce said particles along a path induced by said cyclone at outlet thereof, thereby achieving substantial interaction essentially between said particles, in the center of the plasma flame, without substantial deflection of said particles, on the one hand, and with the substrate on the other hand.

4. A plasma torch according to claim 11, which further comprises an outlet duct on said cyclone to remove a portion of said carrier gas.

5. A plasma torch according to claim 8, which further comprises a filter mounted along said outlet duct to remove fine dust present in the removed portion of said carrier gas.

* * * * *